US007299963B2

(12) United States Patent
Moeller et al.

(10) Patent No.: US 7,299,963 B2
(45) Date of Patent: Nov. 27, 2007

(54) TEMPERATURE SENSOR FOR COMBUSTION NAILER

(75) Inventors: Larry M. Moeller, Schaumburg, IL (US); Mariam Vahabi-Nejad, Chicago, IL (US); Jeffry C. Ford, Zion, IL (US); Clayton O. Henry, Waukegan, IL (US)

(73) Assignee: Illinois Tool Works Inc., Glenview, IL (US)

( * ) Notice: Subject to any disclaimer, the term of this patent is extended or adjusted under 35 U.S.C. 154(b) by 45 days.

(21) Appl. No.: 11/329,436

(22) Filed: Jan. 11, 2006

(65) Prior Publication Data

US 2006/0261122 A1 Nov. 23, 2006

Related U.S. Application Data

(60) Provisional application No. 60/684,088, filed on May 23, 2005.

(51) Int. Cl.
*B25C 1/08* (2006.01)

(52) U.S. Cl. ..... 228/8; 227/10; 123/46 R

(58) Field of Classification Search ..... 227/8, 227/10, 130; 123/46 SC, 46 R
See application file for complete search history.

(56) References Cited

U.S. PATENT DOCUMENTS 4,659,977 A * 4/1987 Kissel et al. ..... 320/150
5,263,439 A 11/1993 Doherty et al.
6,123,241 A 9/2000 Walter et al.
6,247,626 B1 * 6/2001 MacVicar ..... 227/10
6,647,969 B1 * 11/2003 Adams ..... 123/527
6,722,550 B1 * 4/2004 Ricordi et al. ..... 123/46 SC
6,796,476 B2 9/2004 Birk et al.
6,843,401 B2 * 1/2005 Favre-Bulle ..... 227/10
6,866,027 B1 * 3/2005 Marchesini et al. ..... 123/480
6,886,730 B2 5/2005 Fujisawa et al.
6,974,063 B2 * 12/2005 Schiestl et al. ..... 227/9
7,021,251 B2 * 4/2006 Ohmori et al. ..... 123/46 R
7,028,674 B2 * 4/2006 Veinotte ..... 123/518
7,036,703 B2 * 5/2006 Grazioli et al. ..... 227/10
7,040,261 B2 * 5/2006 Granacher et al. ..... 123/46 SC (Continued)

FOREIGN PATENT DOCUMENTS

WO 2004/0873725 9/2004

(Continued)

OTHER PUBLICATIONS

Non-published French application No. 0405714, filed May 27, 2004, Inventors—Toulouse, Herelier, Gleizolles. "Fixing appliance with internal combustion engine with regulating termistor".

*Primary Examiner*—Scott A. Smith
(74) *Attorney, Agent, or Firm*—Greer, Burns & Crain, Ltd.; Lisa M. Soltis; Mark W. Croll

(57) ABSTRACT

A combustion nailer includes a housing substantially enclosing a combustion engine having a cylinder head, a control unit associated with the housing for controlling operation of the tool, at least one printed circuit board electrically connected to the control unit for maintaining tool operation, and at least one temperature sensor mounted on the at least one printed circuit board for monitoring tool temperature and for signaling sensed temperature to the control unit.

17 Claims, 5 Drawing Sheets

U.S. PATENT DOCUMENTS

| | | | | |
|---|---|---|---|---|
| 7,063,052 | B2 * | 6/2006 | Nishikawa et al. | 123/46 SC |
| 7,137,541 | B2 * | 11/2006 | Baskar et al. | 227/120 |
| 2003/0146259 | A1 | 8/2003 | Shkolnikov et al. | |
| 2004/0182336 | A1 | 9/2004 | Ohmori et al. | |
| 2004/0182337 | A1 | 9/2004 | Schiesti et al. | |
| 2005/0173485 | A1 | 8/2005 | Moeller et al. | |
| 2005/0224024 | A1 | 10/2005 | Granacher et al. | |

FOREIGN PATENT DOCUMENTS

| | | | |
|---|---|---|---|
| WO | WO 2005/115697 | A1 | 12/2005 |

* cited by examiner

TEMPERATURE SENSOR FOR COMBUSTION NAILER

RELATED APPLICATION

The present application claims priority under 35 USC § 120 from U.S. Ser. No. 60/684,088 filed May 23, 2005.

BACKGROUND

The present invention relates generally to fastener-driving tools used for driving fasteners into workpieces, and specifically to combustion-powered fastener-driving tools, also referred to as combustion tools or combustion nailers.

Combustion-powered tools are known in the art for use in driving fasteners into workpieces, and examples are described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 5,713,313, all of which are incorporated by reference herein. Similar combustion-powered nail and staple driving tools are available commercially from ITW-Paslode of Vernon Hills, Ill. under the IMPULSE® and PASLODE® brands.

Such tools incorporate a tool housing enclosing a small internal combustion engine or power source. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: mixing the fuel and air within the chamber; turbulence to increase the combustion process; scavenging combustion by-products with fresh air; and cooling the engine. The engine includes a reciprocating piston with an elongated, rigid driver blade disposed within a cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures created by cooling of residual combustion gases within the cylinder. Fasteners are fed magazine-style into the nosepiece, where they are held in a properly positioned orientation for receiving the impact of the driver blade.

The above-identified combustion tools incorporate a fan in the combustion chamber. This fan performs many functions, one of which is cooling. The fan performs cooling by drawing air though the tool between firing cycles. This fan is driven by power supplied by an onboard battery and, to prolong battery life, it is common practice to minimize the run time of the motor. Also, short fan run time reduces fan motor wear (bearings and brushes), limits sound emitting from the tool due to air flow, and most importantly limits dirt infiltration into the tool. To manage fan 'on time', combustion tools typically incorporate a control program that limits fan 'on time' to 10 seconds or less.

Combustion tool applications that demand high cycle rates or require the tool to operate in elevated ambient temperatures often cause tool component temperatures to rise. This leads to a number of performance issues. The most common is an overheated condition that is evidenced by the tool firing but no fastener driven. This is often referred to as a "skip" or "blank fire." As previously discussed, the vacuum return function of a piston is dependent on the rate of cooling of the residual combustion gases. As component temperatures rise, the differential temperature between the combustion gas and the engine walls is reduced. This increases the duration for the piston return cycle to such an extent that the user can open the combustion chamber before the piston has returned, even with a lockout mechanism installed. The result is the driver blade remains in the nosepiece of the tool and prevents advancement of the fasteners. Consequently, a subsequent firing event of the tool does not drive a fastener.

Another disadvantage of high tool operating temperature is that there are heat-related stresses on tool components. Among other things, battery life is reduced, and internal lubricating oil has been found to have reduced lubricating capacity with extended high temperature tool operation. Accordingly, elevated operational temperatures often require more frequent tool maintenance, necessitating unwanted tool downtime.

It is known to place a temperature sensing element in close proximity to the engine or combustion power source and manage the cooling function of the fan to regulate engine temperatures and achieve desirable tool operation. However, due to the significant shock and heat associated with a combustion nailer, design consideration must be given to the construction and/or assembly of the sensing element within the tool to yield reliable operation.

Thus, there is a need for an improved combustion-powered fastener-driving tool which regulates tool operating temperatures within accepted limits to prolong performance and maintain relatively fast piston return to the pre-firing position. In addition, there is a need for an improved combustion-powered fastener-driving tool which manages tool functions in accordance with engine temperatures, and provides a temperature sensor that offers reliable operational life.

BRIEF SUMMARY OF THE INVENTION

The above-listed needs are met or exceeded by the present temperature sensor for a combustion nailer which features a disposition in close proximity to the tool's engine compartment, but yet is sufficiently distant and/or protected that the severe vibrational and temperature stresses inherent with tool operation are reduced. The present sensing element is mounted to a circuit board with connectors for promoting ease of assembly in manufacturing.

In an area adjacent to the circuit board, a heat exchange profile or a cavity in the cylinder head, in which the sensor will be positioned, will expose the sensor to tool operational temperature. At least one mounting screw will provide positive retention of the circuit board to the cylinder head, and a conductor pad on the circuit board will provide circuit ground with the head. The present sensor provides convenient and effective construction that will promote long operational life and relatively accurate temperature readings.

More specifically, a combustion nailer includes a housing substantially enclosing a combustion engine having a cylinder head, a control unit associated with the housing for controlling operation of the tool, at least one printed circuit board electrically connected to the control unit for maintaining tool operation, and at least one temperature sensor mounted on the at least one printed circuit board for monitoring tool temperature and for signaling sensed temperature to the control unit.

In another embodiment, a combustion nailer includes a housing substantially enclosing a combustion engine having a cylinder head, a control unit associated with the housing for controlling operation of the tool, at least one printed circuit board electrically connected to the control unit for maintaining tool operation, and at least one temperature sensor mounted on an underside of the at least one printed circuit board for monitoring tool temperature and for signaling sensed temperature to the control unit, the cylinder head including a pocket projecting from the cylinder head for substantially enclosing the at least one temperature sensor.

In still another embodiment, a combustion nailer includes a housing substantially enclosing a combustion engine having a cylinder head, a control unit associated with the housing for controlling operation of the tool, at least one printed circuit board electrically connected to the control unit for maintaining tool operation, and at least one temperature sensor mounted on the at least one printed circuit board for monitoring tool temperature and for signaling sensed temperature to the control unit, the at least one printed circuit board being connected to the control unit, and the at least one temperature sensor being disposed on the at least one printed circuit board between a trigger and the combustion engine and constructed and arranged to extend through an opening in the housing to be in operational access to the combustion engine.

DETAILED DESCRIPTION OF THE INVENTION

Figure 1:
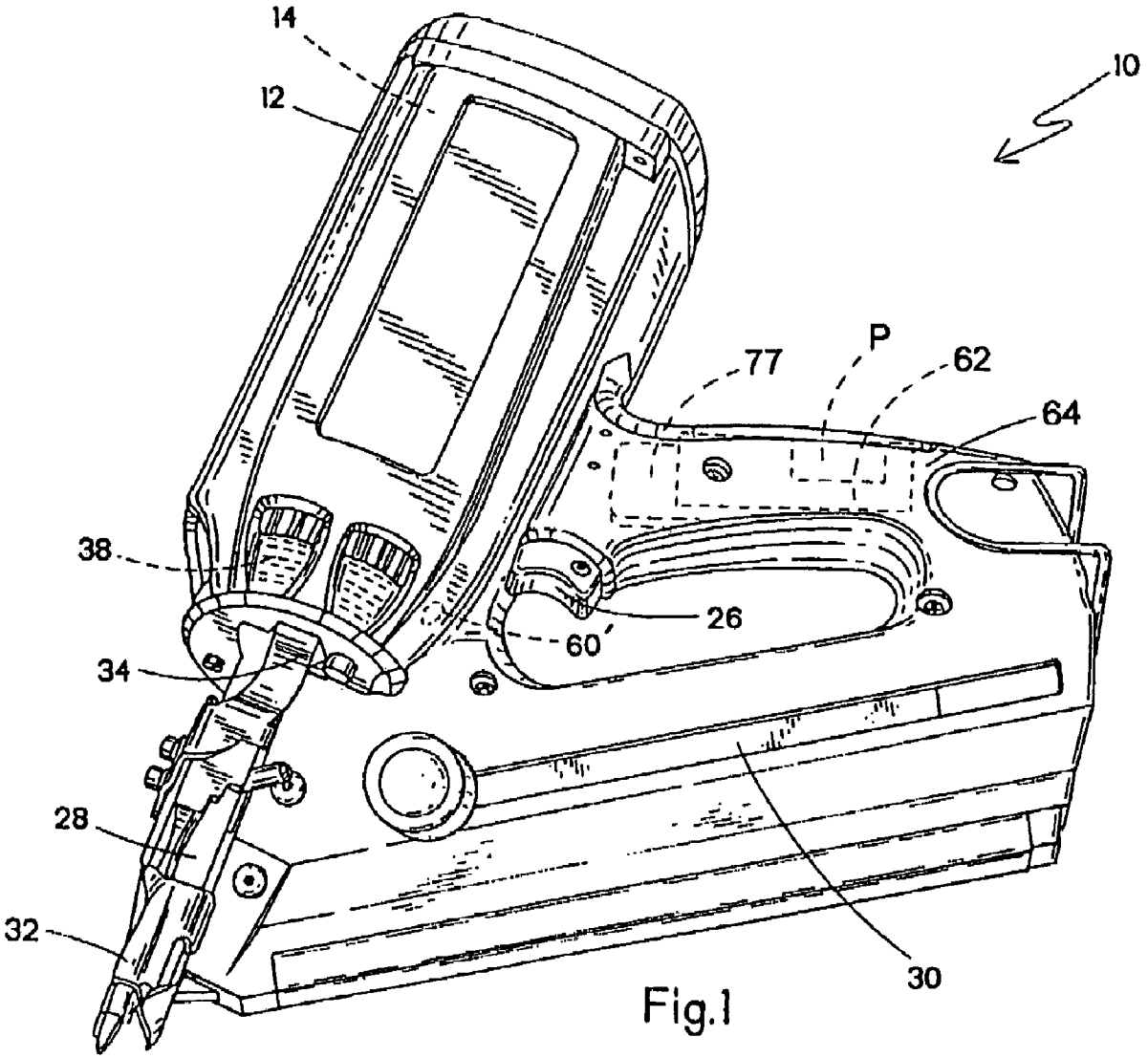
FIG. 1 is a front perspective view of a fastener-driving tool incorporating the present temperature control system.
Figure 2:
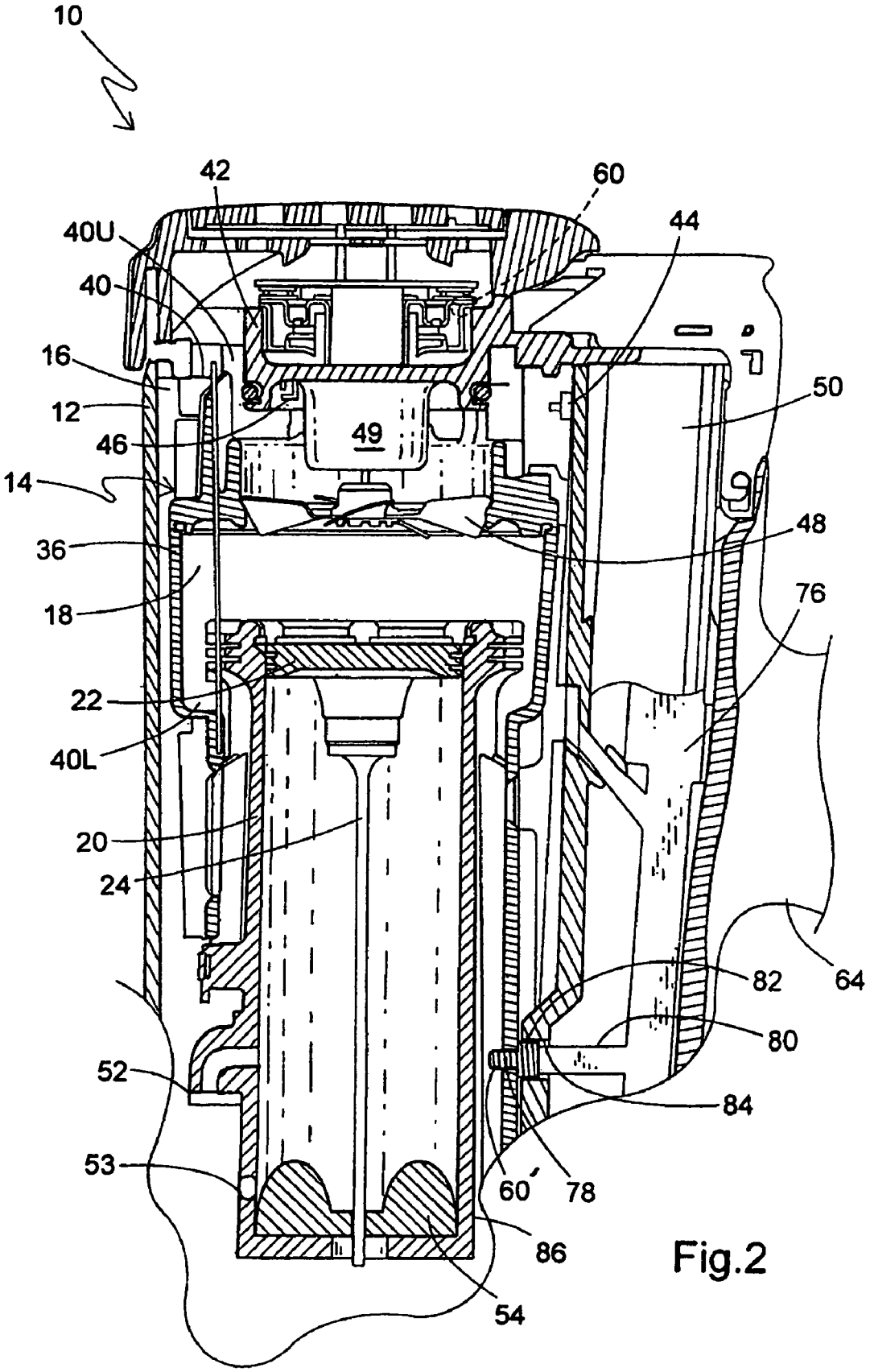
FIG. 2 is a fragmentary vertical cross-section of the tool of FIG. 1 shown in the rest position.

Referring now to FIGS. 1 and 2, a combustion-powered fastener-driving tool, also known as a combustion nailer, incorporating the present control system is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source or combustion engine 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a top dead center or pre-firing position, which occurs just prior to firing, or the ignition of the combustion gases which initiates the downward driving of the driver blade 24 to impact a fastener (not shown) to drive it into a workpiece.

Through depression of a trigger 26 associated with a trigger switch (not shown), an operator induces combustion within the combustion chamber 18, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Included in the nosepiece 28 is a workpiece contact element 32, which is connected, through a linkage 34 to a reciprocating valve sleeve 36, an upper end of which partially defines the combustion chamber 18. Depression of the tool housing 12 against the workpiece contact element 32 in a downward direction as seen in FIG. 1 (other operational orientations are contemplated as are known in the art), causes the workpiece contact element to move from a rest position to a pre-firing position. This movement overcomes the normally downward biased orientation of the workpiece contact element 32 caused by a spring 38 (shown hidden in FIG. 1). Other locations for the spring 38 are contemplated.

Through the linkage 34, the workpiece contact element 32 is connected to and reciprocally moves with, the valve sleeve 36. In the rest position (FIG. 2), the combustion chamber 18 is not sealed, since there is an annular gap 40 including an upper gap 40U separating the valve sleeve 36 and a cylinder head 42, which accommodates a spark plug 46, and a lower gap 40L separating the valve sleeve 36 and the cylinder 20. A chamber switch 44 is located in proximity to the valve sleeve 36 to monitor its positioning. In the preferred embodiment of the present tool 10, the cylinder head 42 also is the mounting point for at least one cooling fan 48 and an associated fan motor 49 which extends into the combustion chamber 18 as is known in the art and described in the patents which have been incorporated by reference above. In addition, U.S. Pat. No. 5,713,313 also incorporated by reference, discloses the use of multiple cooling fans in a combustion-powered tool. In the rest position depicted in FIG. 2, the tool 10 is disabled from firing because the combustion chamber 18 is not sealed at the top with the cylinder head 42 and the chamber switch 44 is open.

Firing is enabled when an operator presses the workpiece contact element 32 against a workpiece. This action overcomes the biasing force of the spring 38, causes the valve sleeve 36 to move upward relative to the housing 12, closing the gaps 40U and 40L, sealing the combustion chamber 18 and activating the chamber switch 44. This action also induces a measured amount of fuel to be released into the combustion chamber 18 from a fuel canister 50 (shown in fragment).

In a mode of operation known as sequential operation, upon a pulling of the trigger 26, the spark plug 46 is energized, igniting the fuel and air mixture in the combustion chamber 18 and sending the piston 22 and the driver blade 24 downward toward the waiting fastener for entry into the workpiece. In an alternative mode of operation known as repetitive firing, ignition is initiated by the closing of the chamber switch 44, since the trigger 26 has already been pulled and the corresponding switch closed. As the piston 22 travels down the cylinder 20, it pushes a rush of air which is exhausted through at least one petal, reed or check valve 52 and at least one vent hole 53 located beyond the piston displacement (FIG. 2). At the bottom of the piston stroke or the maximum piston travel distance, the piston 22 impacts a resilient bumper 54 as is known in the art. With the piston 22 beyond the exhaust check valve 52, high pressure gasses vent from the cylinder 20. Due to cooling of the residual gases, internal pressure differentials created in the cylinder 20 cause the piston 22 to be forced back to the pre-firing position shown in FIG. 2.

To manage those cases where extended tool cycling and/or elevated ambient temperatures induce high tool temperature, at least one temperature sensing device 60 such as a thermistor (shown hidden in FIG. 2) is preferably located on or close to the cylinder head 42. Other types of temperature sensing devices 60 are contemplated besides the thermistor. Also, other locations on the tool 10 are contemplated depending on the application. The temperature sensing device 60 is connected to a control program "P" (shown hidden) and described in commonly assigned, copending U.S. patent application Ser. No. 11/028,020 filed Jan. 3, 2005, which is incorporated by reference. The program is associated with a control unit 62 (shown hidden in FIG. 1), which includes a microprocessor, and is configured to extend 'on time' of the at least one cooling fan 48 until the temperature of the power source 14 is lowered to the preferred "normal" operating range. Alternately, the program is configured to run the fan 48 "on" for a fixed time, for example 90 seconds, which is long enough to assure that the combustion chamber temperature has returned to the "normal" operating range. In the preferred embodiment, the program "P" and the control unit 62 are located in a handle portion 64 of the tool 10. Also, it is contemplated that the microprocessor-based program "P" may be replaced in the control unit 62 by a circuit using discrete components.

The temperature threshold is selected based upon the proximity of the temperature sensing device 60 to the components of the power source 14, the internal forced convection flow stream, and desired cooling effects to avoid nuisance fan operation. Excessive fan run time unnecessarily draws contaminants into the tool 10 and depletes battery power. Other drawbacks of excessive fan run time include premature failure of fan components and less fan-induced operational noise of the tool 10. For demanding high cycle rate applications and/or when elevated ambient temperatures present overheating issues, temperature controlled forced convection will yield more reliable combustion-powered nail performance and will also reduce thermal stress on the tool.

Figure 3:
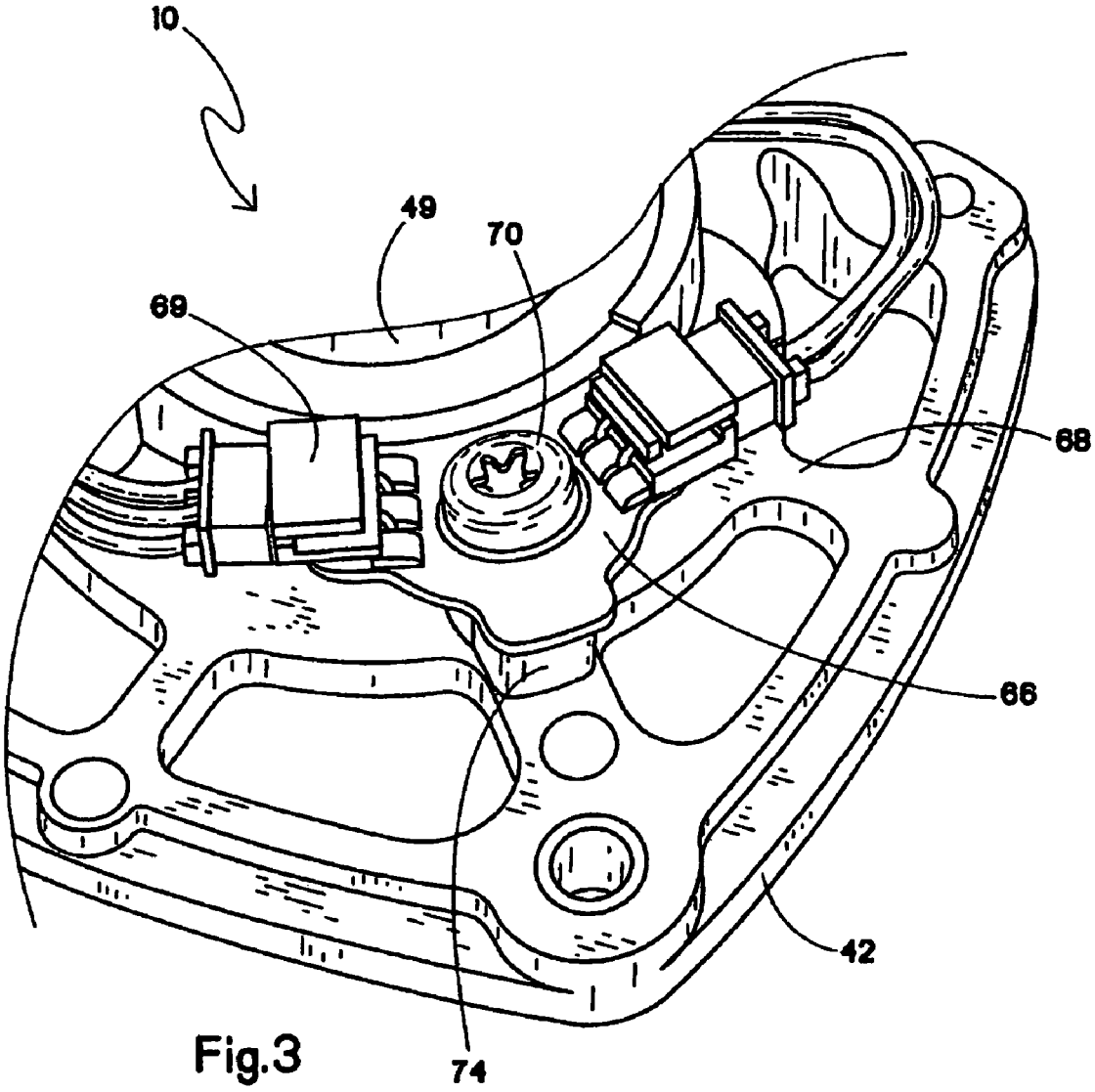
FIG. 3 is a fragmentary top perspective view of the cylinder head of the tool of FIG. 1 depicting the present temperature control sensor.
Figure 4:
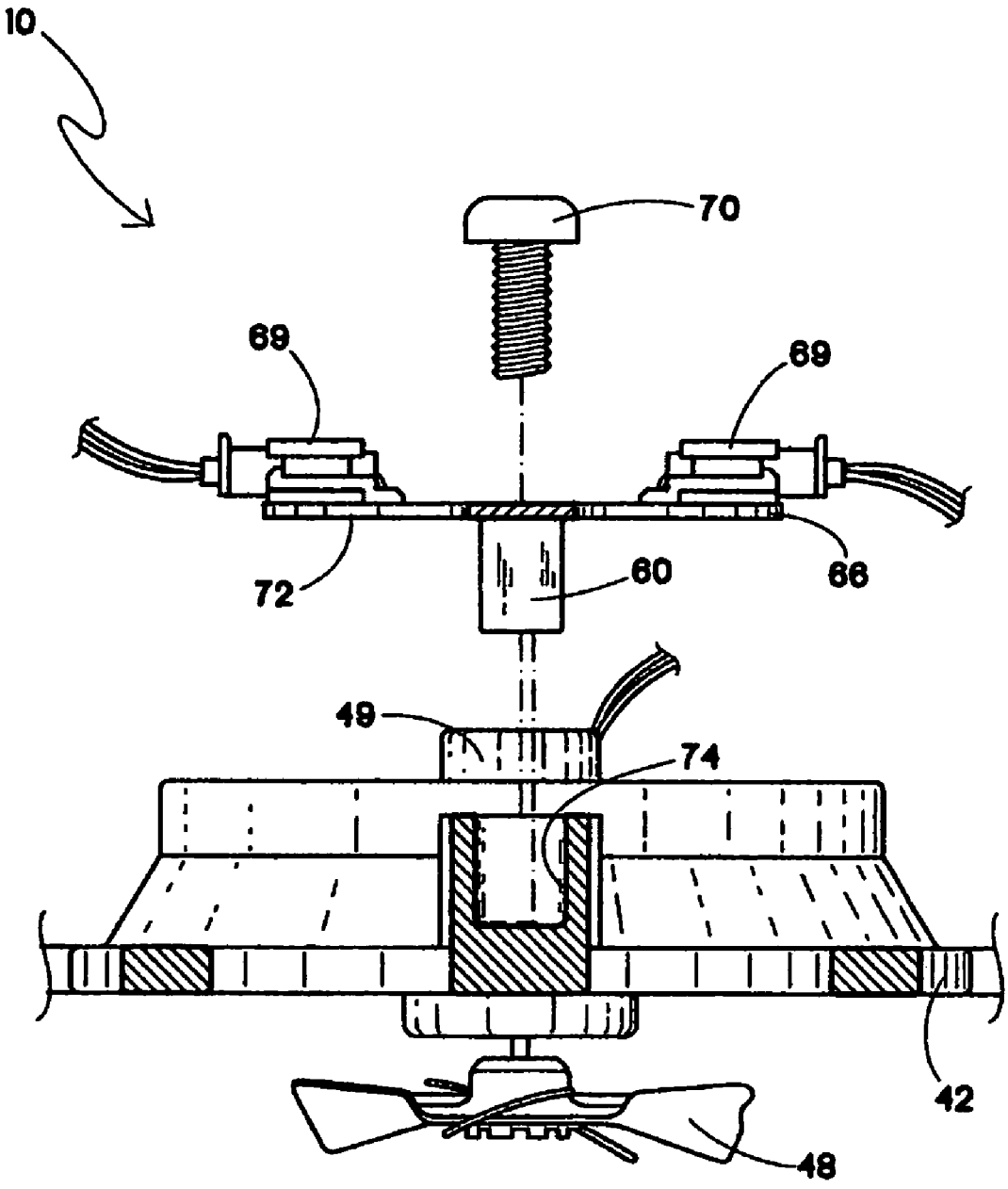
FIG. 4 is an exploded side view of the sensor of FIG. 3.

Referring now to FIGS. 3 and 4, a feature of the present tool 10 is that the temperature sensing device, preferably the temperature sensor 60 (however other known temperature sensing devices are contemplated) is located on a printed circuit board (PCB) 66 associated with, and preferably attached to an upper end 68 of the cylinder head 42 for monitoring tool temperature and for signaling sensed temperature to the control unit 62. As is known in the art, the PCB 66 is electrically connected to the control unit 62 for maintaining tool operation. While other connections are contemplated, the present PCB 66 is shown connecting the temperature sensor 60 and the fan motor 49 with the control unit 62 using push-on connectors 69. Also, the PCB 66 is shown secured to the cylinder head 42 by a threaded fastener 70; however other suitable attachment technologies known in the art such as adhesives, rivets, etc. are contemplated.

To provide accurate combustion engine temperature readings, while protecting the temperature sensor 60 from the harsh operational environment of the combustion engine 14, the temperature sensor is preferably located on an underside 72 of the PCB 66. In addition, the cylinder head 42 is provided with a pocket 74 for accommodating the temperature sensor 60. In the preferred embodiment, the pocket 74 projects vertically from the cylinder head 42 and is integrally cast into the cylinder head, however other orientations, and separate fabrication and attachment is contemplated, but perceived to be less desirable. The pocket 74 is dimensioned to substantially enclose the temperature sensor 60 so that, upon assembly, the temperature sensor is enclosed by the PCB 66 and the pocket 74. As is known in the art, thermal conductive material is placed between the pocket walls and the sensor 60 to promote accurate engine temperature sensing. Electronically, the PCB 66 has a conductor pad (not shown) on the underside 72 that electrically connects with cylinder head 42. This provides a common connection for the fan motor 49, ignition ground, and the temperature sensor 60 to improve manufacturability.

Referring now to FIG. 2, it is also contemplated that the temperature sensor 60, referred to as 60' for purposes of clarity only, is locatable in an alternate location, as depicted in FIG. 1. However, multiple temperature sensors 60, 60' are contemplated in the tool 10. More specifically, the location of the temperature sensor 60' is inside the housing 12 between the trigger 26 and the combustion engine 14, and in the path of the internal forced convection flow stream induced by the fan 48.

Figure 5:
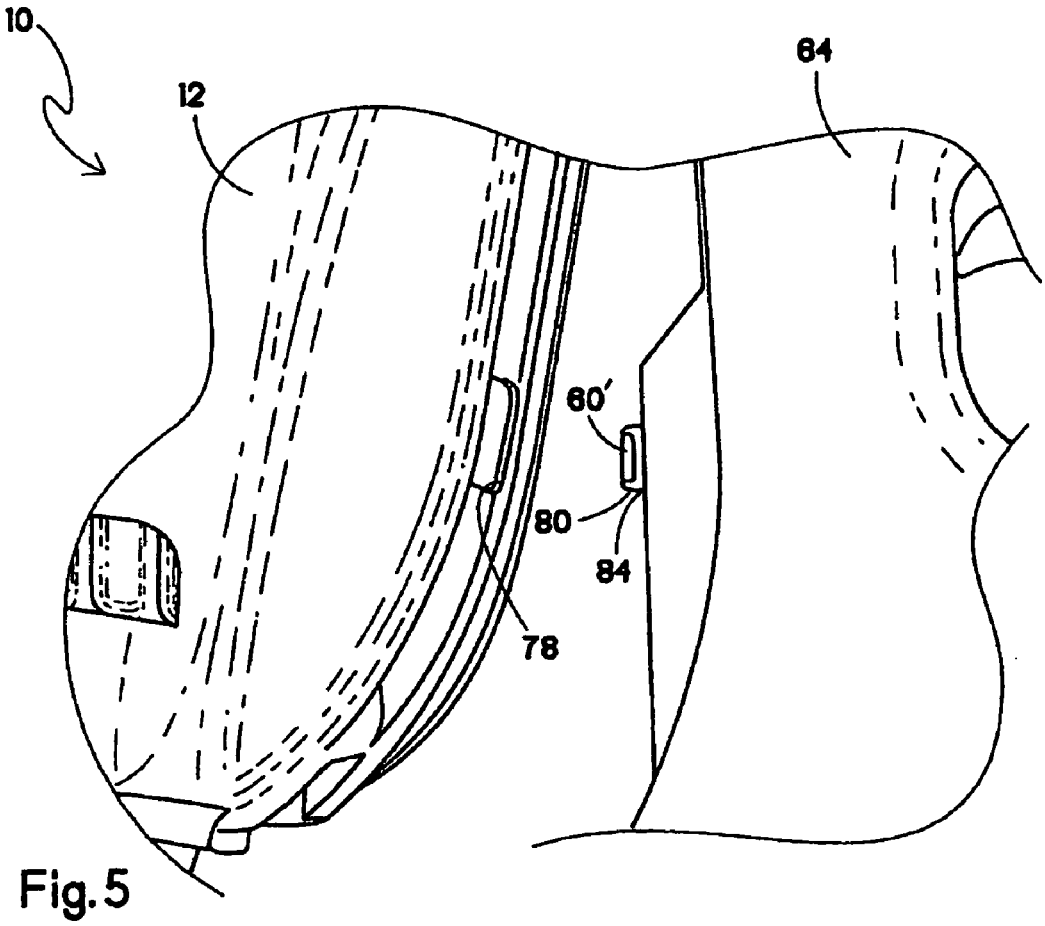
FIG. 5 is a fragmentary, partially exploded side elevation of the tool of FIG. 1 equipped with another temperature sensor.
Figure 6:
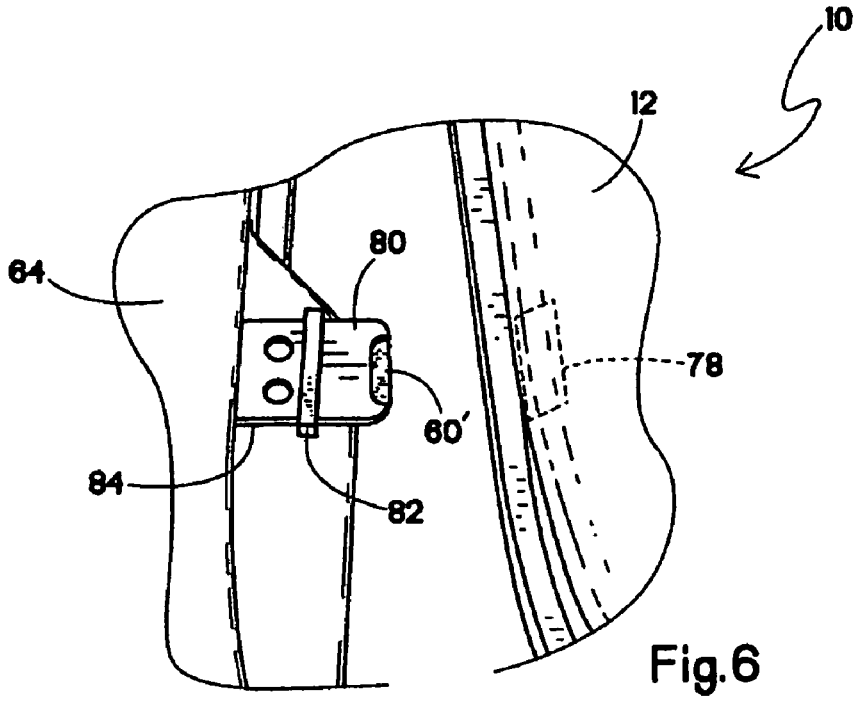
FIG. 6 is a fragmentary reverse side elevation of the sensor of FIG. 5.

Referring now to FIGS. 2, 5 and 6, placing the temperature sensor 60' between the trigger 26 and the combustion engine 14 is preferably achieved by locating the temperature sensor on a circuitry PCB 76 associated with, and preferably electrically connected with the control unit 62. As is known in the art, the PCB 76 electrically connects the control unit 62 control unit to the cylinder head 42. While in the preferred embodiment, the circuitry PCB 76 is a separate circuit board from a control unit PCB 77 (shown hidden in FIG. 1), it is contemplated that the temperature sensor 60' is mountable on a PCB which is unitary with the control unit PCB. Also, the electrical connection of the temperature sensor 60, 60' to the control unit 62 enables the control unit to apply the sensed temperature signals to various tool functions, including but not limited to fan run time, combustion chamber lockout mechanisms, spark generation and fuel delivery.

To accommodate the temperature sensor 60', the housing 12 is provided with at least one aperture 78 dimensioned to tightly engage the temperature sensor and the associated portion of the circuitry PCB 76 to minimize air leakage. A portion 80 of the PCB 76, bearing the temperature sensor 60', is attached and projects normally from the associated PCB 76. A formation 82 on the extension 80 is laterally enlarged to create a flange or otherwise dimensioned to tightly engage the aperture 78. Also, in the preferred embodiment, a supplemental aperture 84 is provided on the handle portion 64 to accept extension 80 and is in registry with the aperture 78 in the housing 12. The aperture 78 is disposed in the housing 12 such that, upon being engaged therein, the temperature sensor 60' is adjacent an exterior 86 of the cylinder 20 and in the path of the internal forced convection flow stream.

It will be seen that the present temperature sensor for a combustion nailer provides for placement of temperature sensors 60, 60' on and/or in close proximity to the combustion engine 14 while also protecting the sensors from the harsh working environment of combustion nailers. The presently described sensor mounting arrangements reduce wiring to the sensor and reduce manufacturing costs.

While particular embodiments of the present temperature sensor for a combustion nailer has been described herein, it will be appreciated by those skilled in the art that changes and modifications may be made thereto without departing from the invention in its broader aspects and as set forth in the following claims.

The invention claimed is:

1. A combustion nailer, comprising:

a housing substantially enclosing a combustion engine having a cylinder head;

a control unit associated with said housing for controlling operation of the tool;

at least one printed circuit board electrically connected to said control unit for maintaining tool operation;

at least one temperature sensor mounted on said at least one printed circuit board for monitoring tool temperature and for signaling sensed temperature to said control unit; and said at least one circuit board having said at least one temperature sensor being disposed upon an upper end of said cylinder head such that the cylinder head is between said at least one temperature sensor and a combustion chamber of said engine.

2. The combustion nailer of claim 1 further including a pocket in said cylinder head for accommodating said at least one temperature sensor.

3. The combustion nailer of claim 2 wherein said temperature sensor is disposed upon an underside of said circuit board and, upon insertion into said pocket, said at least one temperature sensor is enclosed by said pocket and said circuit board.

4. The combustion nailer of claim 1 wherein said circuit board is provided with push-on connectors for connecting said temperature sensor to said control unit.

5. The combustion nailer of claim 1 wherein said at least one circuit board having said at least one temperature sensor is located in said housing between a trigger and said combustion engine.

6. The combustion nailer of claim 5 wherein said at least one circuit board is an extension of a circuit board connecting said temperature sensor to said control unit.

7. The combustion nailer of claim 6 wherein said extension is on a circuit board which is separate from a control unit circuit board supporting said control unit.

8. The combustion nailer of claim 6 wherein said extension projects generally normally from said circuit board.

9. The combustion nailer of claim 8 wherein said extension projects from a handle portion of the housing through a supplemental aperture which is in registry with said aperture in said housing.

10. The combustion nailer of claim 8 wherein said aperture is disposed in said housing such that, upon being engaged therein, said sensor is adjacent an exterior of a cylinder of a combustion engine in said tool.

11. The combustion nailer of claim 5 wherein said temperature sensor is received in an aperture in said housing configured to tightly engage said sensor and an associated circuit board formation.

12. The combustion nailer of claim 1 wherein said cylinder head supports a fan motor provided with a fan projecting into a combustion chamber, and said at least one circuit board is located on said upper surface of said cylinder head generally adjacent said fan motor.

13. A combustion nailer, comprising:

a housing substantially enclosing a combustion engine having a cylinder head;

a control unit associated with said housing for controlling operation of the tool;

at least one printed circuit board electrically connected to said control unit for maintaining tool operation;

at least one temperature sensor mounted on an underside of said at least one printed circuit board for monitoring tool temperature and for signaling sensed temperature to said control unit;

said cylinder head including a pocket for substantially enclosing said at least one temperature sensor.

14. The combustion nailer of claim 13 wherein said at least one printed circuit board is accommodated upon said pocket.

15. A combustion nailer, comprising:

a housing substantially enclosing a combustion engine having a cylinder head;

a control unit associated with said housing for controlling operation of the tool;

at least one printed circuit board electrically connected to said control unit for maintaining tool operation;

at least one temperature sensor mounted on said at least one printed circuit board for monitoring tool temperature and for signaling sensed temperature to said control unit;

said at least one printed circuit board being connected to said control unit, and said at least one temperature sensor being disposed on said at least one printed circuit board between a trigger and said combustion engine and constructed and arranged to extend through a corresponding opening in said housing to be in operational access to said combustion engine.

16. The combustion nailer of claim 15 wherein said temperature sensor is received in an aperture in said housing configured to tightly engage said sensor and an associated circuit board formation.

17. The combustion nailer of claim 16 wherein said circuit board formation projects normally from said printed circuit board.

* * * * *